United States Patent [19]

Takagi et al.

[11] Patent Number: 5,057,856

[45] Date of Patent: Oct. 15, 1991

[54] LIQUID JET HEAD, SUBSTRATE OF (TIZRHFNB) FENICR AND LIQUID JET HEAD AND APPARATUS USING THE SAME

[75] Inventors: Hiroshi Takagi, Yokohama; Atsushi Shiozaki, Isehara, both of Japan

[73] Assignee: Canon Kabushiki Kaisha, Tokyo, Japan

[21] Appl. No.: 652,364

[22] Filed: Feb. 7, 1991

Related U.S. Application Data

[63] Continuation of Ser. No. 519,307, May 8, 1990, abandoned, which is a continuation of Ser. No. 278,491, Dec. 1, 1988, abandoned.

[30] Foreign Application Priority Data

Dec. 1, 1987 [JP] Japan ..... 62-303713

[51] Int. Cl.[5] ..... B41J 2/05

[52] U.S. Cl. ..... 346/140 R

[58] Field of Search ..... 346/140 PD

[56] References Cited

U.S. PATENT DOCUMENTS 4,296,421 10/1981 Hara et al. .
4,335,389 6/1982 Shirato et al. ..... 346/140 PD
4,392,907 7/1983 Shirato et al. .
4,450,457 5/1984 Miyachi et al. ..... 346/140 PD
4,567,493 1/1986 Ikeda et al. ..... 346/140 PD
4,577,202 3/1986 Hara ..... 346/140 PD
4,725,859 2/1988 Shibata et al. ..... 346/140 PD
4,756,967 7/1988 Hashimoto et al. .

FOREIGN PATENT DOCUMENTS 128467 10/1980 Japan .
194866 11/1984 Japan .

*Primary Examiner*—George H. Miller, Jr.
*Attorney, Agent, or Firm*—Fitzpatrick, Cella, Harper & Scinto

[57] ABSTRACT

A liquid jet head comprises an electrothermal transducer having a heat-generating resistor and a pair of electrodes connected electrically to the heat-generating resistor; a base plate for supporting the electrothermal transducer; a protective layer formed on the electrothermal transducer using an amorphous alloy containing at least one selected from the group consisting of Ti, Zr, Hf, Nb, Ta and W as well as Fe, Ni and Cr; and a liquid path formed on the base plate corresponding to the heat generating portion of the electrothermal transducer formed between the pair of electrodes, and communicated to a discharge opening for discharging liquid.

133 Claims, 2 Drawing Sheets

LIQUID JET HEAD, SUBSTRATE OF (TIZRHFNB) FENICR AND LIQUID JET HEAD AND APPARATUS USING THE SAME

This application is a continuation of application Ser. No. 519,307, filed May 8, 1990, now abandoned, which is a continuation of application Ser. No. 278,491, filed Dec. 1, 1988, now abandoned.

BACKGROUND OF THE INVENTION

1. Field of the Invention

This invention relates to a liquid jet head which performs recording by discharging liquid for recording ink, etc. utilizing heat energy to form droplets and attaching such droplets onto a recording medium such as paper, as well as to a substrate for the head and a liquid jet recording apparatus equipped therewith.

2. Related Background Art

A recording for the liquid jet recording method which utilizes heat energy for formation of a droplet to be discharged generally comprises a base plate having an opening for discharging liquid; a liquid path communicated to said discharging opening having a portion at which heat energy for discharging the liquid is generated by an electro-thermal transducer and a pair of electrodes connected to said heat-generating resistor. The head may have, for example, a structure shown in the schematic exploded perspective view in FIG. 2.

Among the recording heads having such constitution, for example, are the recording heads disclosed in Japanese Laid-open Patent Publication Nos. 55-128467 and 59-194866, which as shown in FIG. 1, comprise a substrate 202 a heat-generating resistor 208 for generating heat energy, electrodes 209 and 210 for supplying electrical signals thereto and protective layers 213 and 214 laminated thereon for protection from liquid and are formed according to thin film forming technique, etc. The recording head comprises a liquid path 204 corresponding to the heat generating portion 201 of the heat-generating resistor 208 and a discharging outlet 217 formed on the substrate.

The first protective layer 213 of the above protective layers 213 and 214 primarily insulates between the electrodes 209 and 210, while the second protective layer 214 surfaces liquid resistance and mechanical strength.

As the material for forming the second protective layer 214, there have been known in the art noble metals, (elements of the group VIII, etc.), high melting transition elements (elements of the groups III, IV, V, VI, etc.), alloys of these, or nitrides, borides, silicides, carbides of these metals or amorphous silicon, etc.

The useful life of the recording head having a protective layer on the heat-generating resistor described above depends greatly on the performance of the protective layer on the heat-generating portion of the heat-generating resistor.

That is, since the protective layer is subject to the heat which gas lies the liquid and thus, the cavitation shock created during droplet discharging and chemical action of liquid, it must breaking, liquid and oxidation resistance, etc.

However, no material for formation of protective layer satisfying all of these requirements, particularly for formation of second protective layer, has been known in the art.

For example, in the protective layer comprising nitrides, borides, silicides or carbides of the above metals sometimes feature the drawback of weak resistance to mechanical shock by cavitation shock, which may be due to the covalent atomic bonds of such compounds.

SUMMARY OF THE INVENTION

The present inventors, in order to solve the above problems, have made various investigations about the material for formation of protective layer satisfying the requirements as described above and consequently, have found a material of protective layer which can satisfy all of the above requirements and accomplish the present invention thereby.

An object of the present invention is to provide a liquid jet recording head having a protective layer with excellent impact heat, breaking, liquid and oxidation resistance, etc., a substrate for the said head and a liquid jet recording apparatus equipped with the said head.

According to an aspect of the present invention, there is provided a liquid jet head comprising

- an electrothermal transducer having a heat-generating resistor connected electrically to a pair of electrodes;
- a base plate for supporting the electrothermal transducer;
- a protective layer formed on said electrothermal transducer using at least one amorphous alloy selected from the group consisting of Ti, Zr, Hf, Nb, Ta and W as well as Fe, Ni and Cr; and
- a liquid path formed on the base plate corresponding to the heat generating portion of the electrothermal transducer formed between the pair of electrodes, communicated to a discharge opening for discharging liquid.

According to another aspect of the present invention, there is provided a substrate for the above liquid jet recording head, as well as a liquid jet apparatus equipped with the aforesaid liquid jet head.

DESCRIPTION OF THE INVENTION

The composition of the amorphous alloy to be used for formation of the second protective layer of the recording head of the present invention is represented by:

$$M_x(Fe_{100-y-z}Ni_yCr_z)_{100-x}$$

wherein x is selected such that the alloy may be amorphous, for example, in the range of 10 to 70 atomic %, preferably 20 to 70 atomic %.

On the other hand, y should be desirably made 5 to 30 atomic % and z 10 to 30 atomic %.

M represents at least one selected from the group consisting of Ti, Zr, Hf, Nb, Ta and W. That is, these elements may be used either singly or in a plural number thereof, as desired.

The amorphous alloy film represented by the above compositional formula has excellent properties as the constituent material of the second protective layer directly in contact with liquid such as heat resistance, corrosion resistance, mechanical strength, etc.

For formation of the second protective layer (one shown by 214 in FIG. 1) by use of the amorphous alloy film, conventional thin film deposition techniques, etc. may be applicable, but the sputtering method is suitable from the standpoint of obtaining readily a highly dense and strong amorphous alloy film.

Also, by heating the base plate during formation of the film to 100° to 200° C., a strong adhesive force can be obtained.

The second protective layer should preferably have a film thickness of 0.1 to 5 μm, more preferably 0.2 to 3 μm.

Figure 1:
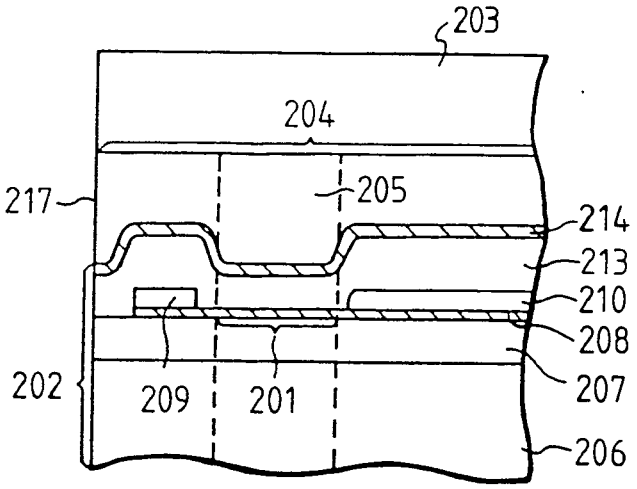
FIG. 1 is a partial sectional view showing the structure of the principal part of the liquid recording head.
Figure 2:
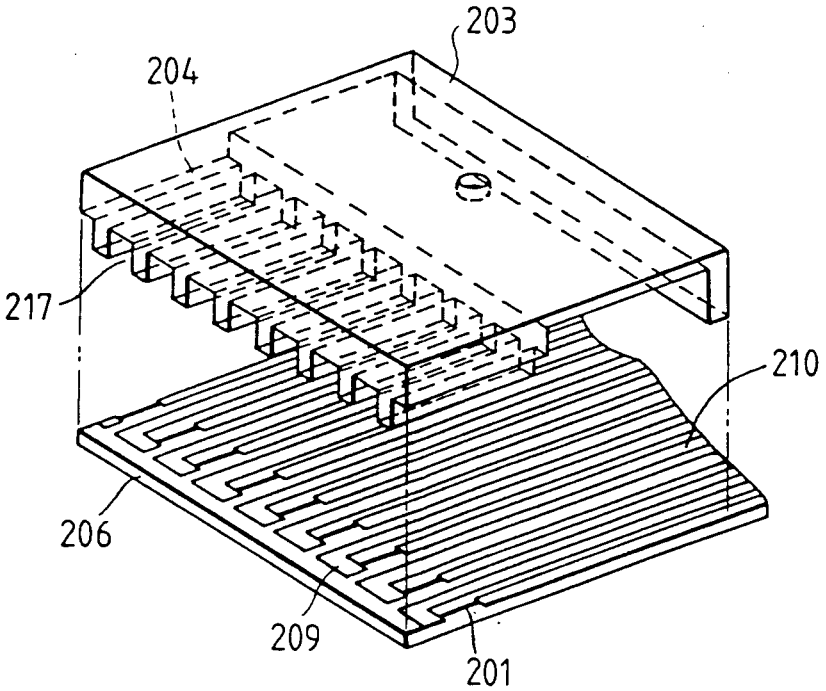
FIG. 2 is an exploded perspective view showing the structure of the principal part of the liquid jet recording head.

Except for the second protective layer 214 is not limited to the constitution shown in FIG. 1 and FIG. 2, but it may have any desired constitution.

For example, other protective layers than the first and second protective layers may be provided as laminated in the liquid jet head of the present invention.

The direction of ink supply to the heat generating portion of the liquid path may be substantially same as or different from (e.g. forming substantially a right angle with) the direction of ink discharge.

Further, in the liquid jet hed of the present invention, the layer of heat generating resistor and the layer of electrode may be provided in a reverse (upset) arrangement.

In addition, the liquid jet head may be of a so-called full line type which has discharge openings over the whole range of the recording width of receiving material.

As the material for formation of the first protective layer, a heat-resistant insulating material such as $SiO_2$, SiN, etc. may be employed suitably.

The present invention is described in more detail below by referring to the following Examples and Comparative Examples.

EXAMPLE 1

By use of an Si wafer having an $SiO_2$ film of 5 μm as the heat accumulating lower layer 207 provided on its surface by the heat oxidation treatment as the base plate 206, a film of $HfB_2$ with a thickness of 1500 Å was formed by the sputtering method as the heat-generating resistor layer on the lower layer 207, followed further by film formation of an Al layer thereon with a thickness of 5000 Å by sputtering.

Next, the Al layer and the heat-generating resistor layer were subjected to patterning according to the photolithographic steps to a desired shape as shown in FIG. 2 to form an electrothermal transducer having a heat-generating resistor 208 and a pair of electrodes 209 and 210.

Further, after $SiO_2$ as the first protective layer 213 was laminated to a thickness of 1 μm by sputtering on the electrothermal transducer $Ta_{50}(Fe_{73}Ni_{10}Cr_{17})_{50}$ with a film thickness of 0.5 μm was laminated by sputtering on the $SiO_2$ layer.

On the planar substrate 202 having an electrothermal transducer protected with the protective layers as described above, a cover member of glass plate 203 having a groove which becomes the liquid path 204 was laminated through an epoxy type adhesive to obtain a liquid jet recording head having the constitution as shown in FIG. 1 and FIG. 2.

EXAMPLE 2

A recording head was prepared in the same manner as in Example 1 except for forming by sputtering $Ti_{25}(Fe_{73}Ni_{10}Cr_{17})_{75}$ with a thickness of 2300 Å as second protective layer.

EXAMPLE 3

A recording head was prepared in the same manner as in Example 1 except for forming by sputtering $Zr_{28}(Fe_{73}Ni_{10}Cr_{17})_{72}$ with a thickness of 2000 Å as the second protective layer.

EXAMPLE 4

A recording head was prepared in the same manner as in Example 1 except for forming by sputtering $Hf_{28}(Fe_{73}Ni_{10}Cr_{17})_{72}$ with a thickness of 2100 Å as the second protective layer.

EXAMPLE 5

A recording head was prepared in the same manner as in Example 1 except for forming by sputtering $Nb_{56}(Fe_{68}Ni_{11}Cr_{21})_{44}$ with a thickness of 2400 Å as the second protective layer.

EXAMPLE 6

A recording head was prepared in the same manner as in Example 1 except for forming by sputtering $W_{31}(Fe_{68}Ni_{11}Cr_{21})_{69}$ with a thickness of 2100 Å as the second protective layer.

EXAMPLE 7

A recording head was prepared in the same manner as in Example 1 except for forming by sputtering $Ta_{32}Ti_{18}(Fe_{73}Ni_{10}Cr_{17})_{50}$ with a thickness of 2500 Å as the second protective layer.

EXAMPLE 8

A recording head was prepared in the same manner as in Example 1 except for forming by sputtering $Nb_{28}Zr_{20}(Fe_{73}Ni_{10}Cr_{17})_{52}$ with a thickness of 2500 Å as the second protective layer.

EXAMPLE 9

A recordding head was prepared in the same manner as in Example 1 except for forming by sputtering $Hf_{35}W_{22}(Fe_{73}Ni_{10}Cr_{17})_{43}$ with a thickness of 2500 Å as the second protective layer.

EXAMPLE 10

A recording head was prepared in the same manner as in Example 1 except for forming by sputtering $Ta_{40}Ti_{13}Nb_{11}(Fe_{73}Ni_{10}Cr_{17})_{36}$ with a thickness of 2500 Å as the second protective layer.

COMPARATIVE EXAMPLE 1

A recording head was prepared in the same manner as in Example 1 except for forming by sputtering $Ti_{9}(Fe_{73}Ni_{10}Cr_{17})_{91}$ with a thickness of 2400 Å as the second protective layer.

The film having this composition was analyzed by X-ray diffractometry to be a polycrystalline film.

By use of the recording heads obtained in Examples 1 to 6 and Comparative example 1, respectively, recording was performed by use of ink for liquid jet recording under the following conditions for testing of its durability.

Recording conditions: with the driving pulse being made 2 KHz, 5 μsec., the applied energy was made 1.3-fold of the liquid jet threshold value energy.

Figure 3:
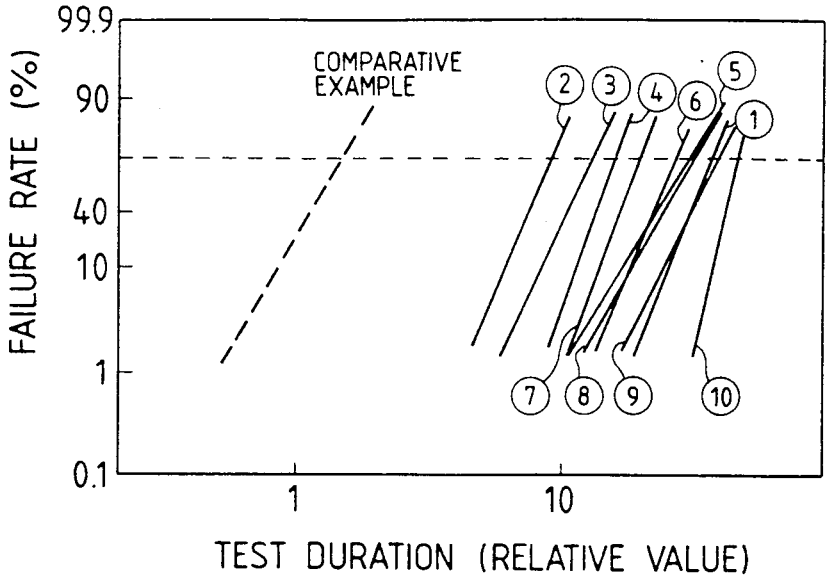
FIG. 3 is a Weibull plot showing the results of durability tests of the liquid jet recording heads obtained in Examples and Comparative example.

FIG. 3 shows the Weibull plot of failure rate prepared from the results obtained. The time point when the resistance value of the heat-generating resistor exceeded 120% of the initial value was deemed as failure.

As is apparent from FIG. 3, the recording heads of the present invention of Examples 1 to 10 were all found to have longer life relative to the recording head prepared in Comparative Example 1.

When the causes for failures in the above durability tests were examined, it was found that the failures were caused as the result of corrosion of the second protective layer extending to the first protective layer and further to the heat-generating resistor.

EXAMPLE 11

A substrate for liquid jet head and a liquid jet head formed using the substrate of the present invention were prepared in the same manner as in Example 1 except for using SiN as the material of the first protective layer 213.

Also in this example, a substrate for liquid jet head and a liquid jet head formed using the substrate having various excellent characteristics such as durability could by obtained.

EXAMPLE 12

A substrate for liquid jet head and a liquid jet head formed using the substrate of the present invention were prepared in the same manner as in Example 2 except for additionally performing the steps of forming by spin coating a polyimide layer as a third protective layer on the second protective layer 214 and then removing the said layer on the heat generating portion.

Also in this example, a substrate for liquid jet head and a liquid jet head formed using the substrate having various excellent characteristics such as durability could be obtained.

Incidentally, in the present invention, the liquid path of the liquid jet head may be formed by initially forming the wall-forming member for liquid path using e.g. photosensitive resin and then attaching a top plate onto the wall-forming member.

Figure 4:
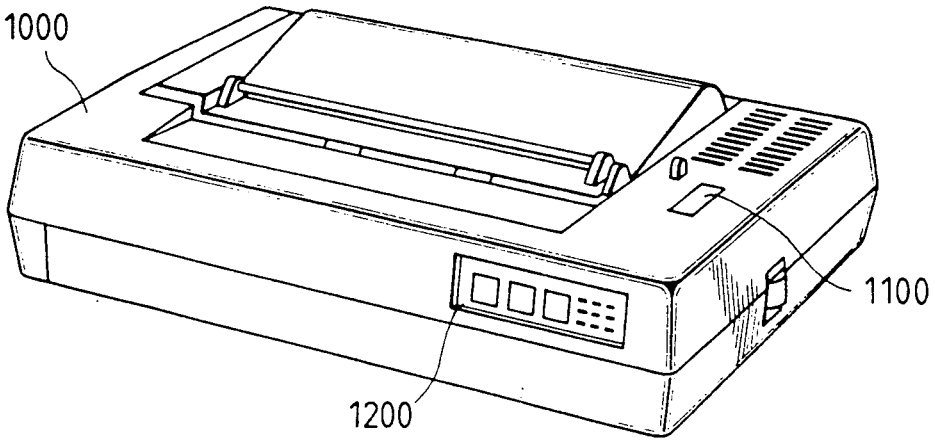
FIG. 4 is a schematic perspective view showing the appearance of the liquid jet apparatus equipped with the liquid jet head of the present invention.

FIG. 4 is a schematic perspective view showing the appearance of the liquid jet apparatus equipped with the liquid jet head of the present invention. There are shown in FIG. 4 the main body of the apparatus 1000, power switch 1100 and operation panel 1200.

As described above in detail, the liquid jet head formed using the substrate for liquid jet head of the present invention has sufficient durability due to the use of an amorphous alloy film having the aforementioned specific composition and being excellent in heat resistance, liquid resistance and mechanical impact resistance as a protective layer, thereby having extremely long life and high durability.

We claim:

1. An ink jet head, comprising:

an electrothermal transducer having a heat-generating resistor and a pair of electrodes electrically connected to said heat-generating resistor;

a base plate supporting said electrothermal transducer;

a protective layer on said electrothermal transducer of an amorphous alloy containing at least one material selected from the group consisting of Ti, Zr, Hf, Nb, Ta, W, Fe, Ni and Cr; said amorphous alloy being represented by the formula $$M_x(Fe_{100-y-z}Ni_yCr_z)_{100-x}$$

wherein M is at least one element selected from the group consisting of Ti, Zr, Hf, Nb, Ta and W, and x is 10–70; and a liquid path corresponding to the heat generating portion of said electrothermal transducer communicating with a discharge opening for discharging liquid.

2. An ink jet head according to claim 1, wherein the member for forming said liquid path on said support is a covering member having a groove for forming said liquid path.

3. An ink jet head, comprising:

an electrothermal transducer having a heat-generating resistor and a pair of electrodes electrically connected to said heat-generating resistor;

a base plate supporting said electrothermal transducer;

a protective layer on said electrothermal transducer of an amorphous alloy containing at least one material selected from the group consisting of Ti, Zr, Hf, Nb, Ta, W, Fe, Ni and Cr, wherein said amorphous alloy is represented by $$M_x(Fe_{100-y-z}Ni_yCr_z)_{100-x}$$

wherein M is at least one element selected from the group consisting of Ti, Zr, Hf, Nb, Ta and W, and y is 5–30; and a liquid path corresponding to the heat generating portion of said electrothermal transducer communicating with a discharge opening for discharging liquid.

4. An ink jet head, comprising:

an electrothermal transducer having a heat-generating resistor and a pair of electrodes electrically connected to said heat-generating resistor;

a base plate supporting said electrothermal transducer;

a protective layer on said electrothermal transducer of an amorphous alloy containing at least one material selected from the group consisting of Ti, Zr, Hf, Nb, Ta, W, Fe, Ni and Cr, wherein said amorphous alloy is represented by $$M_x(Fe_{100-y-z}Ni_yCr_z)_{100-x}$$

wherein M is at least one element selected from the group consisting of from Ti, Zr, Hf, Nb, Ta and W, and z is 10–30; and a liquid path corresponding to the heat generating portion of said electrothermal transducer communicating with a discharge opening for discharging liquid.

5. An ink jet head according to claim 1, 3 or 4 wherein said amorphous alloy is represented by $$M_x(Fe_{100-y-z}Ni_yCr_z)_{100-x}$$

wherein M is at least one selected from Ti, Zr, Hf, Nb, Ta and W, and x is 20–70.

6. An ink jet head according to claim 1, 5 or 3 wherein said amorphous alloy is $Ta_{50}(Fe_{73}Ni_{10}Cr_{17})_{50}$.

7. An ink jet head according to claim 1, 5 or 3 wherein said amorphous alloy is $Ti_{25}(Fe_{73}Ni_{10}Cr_{17})_{75}$.

8. An ink jet head according to claim 1, 5 or 3 wherein said amorphous alloy is $Zr_{28}(Fe_{73}Ni_{10}Cr_{17})_{72}$.

9. An ink jet head according to claim 1, 5 or 3 wherein said amorphous alloy is $Hf_{28}(Fe_{73}Ni_{10}Cr_{17})_{72}$.

10. An ink jet head according to claim 1, 5 or 3 wherein said amorphous alloy is $Nb_{56}(Fe_{68}Ni_{11}Cr_{21})_{44}$.

11. An ink jet head according to claim 1, wherein said amorphous alloy is $W_{31}(Fe_{68}Ni_{11}Cr_{21})_{69}$.

12. An ink jet head according to claim 1, 5 or 3 wherein said amorphous alloy is $Ta_{32}Ti_{18}(Fe_{73}Ni_{10}Cr_{17})_{50}$.

13. An ink jet head according to claim 1, 5 or 3 wherein said amorphous alloy is $Nb_{28}Zr_{20}(Fe_{73}Ni_{10}Cr_{17})_{52}$.

14. An ink jet head according to claim 1, 5 or 3 wherein said amorphous alloy is $Hf_{35}W_{22}(Fe_{73}Ni_{10}Cr_{17})_{43}$.

15. An ink jet head according to claim 1, 5 or 3 wherein said amorphous alloy is $Ta_{40}Ti_{13}Nb_{11}(Fe_{73}Ni_{10}Cr_{17})_{36}$.

16. An ink jet head according to claim 1, 5 or 3 wherein the thickness of said protective layer is 0.1–5 μm.

17. An ink jet head according to claim 1, 5 or 3 wherein the thickness of said protective layer is 0.2–3 μm.

18. An ink jet head according to claim 1, 5 or 3 wherein said heat-generating resistor is formed between said base plate and said electrode.

19. An ink jet head according to claim 1, 5 or 3 wherein said electrode is formed between said base plate and said heat-generating resistor.

20. An ink jet head according to claim 1, 5 or 3 wherein said electrothermal transducer generates heat energy used for discharging liquid.

21. An ink jet head according to claim 1, 5 or 3 wherein the direction of ink discharge from said discharge opening is substantially same as the direction of ink supply to said heat-generating portion.

22. An ink jet head according to claim 1, 5 or 3 wherein the direction of ink discharge from said discharge opening is different from the direction of ink supply to said heat-generating portion.

23. An ink jet head according to claim 22, wherein said two directions form substantially right angle.

24. An ink jet head according to claim 1, 5 or 3 wherein said discharge opening is provided in a plural number.

25. An ink jet head according to claim 1, 5 or 3 wherein said discharge opening is provided in a plural number corresponding to the width of recording medium.

26. An ink jet head according to claim 1, 5 or 3 wherein the member for forming said liquid path on said support comprises a wall-forming member forming the wall of said liquid path and a top plate bonded to said wall-forming member.

27. An ink jet head according to claim 2, wherein said wall-forming member is formed using a photosensitive resin.

28. An ink head according to claim 1, 5 or 3 wherein another protective layer is provided between said base plate and said protective layer.

29. An ink jet head according to claim 27, wherein said another protective layer is formed using a heat resistant insulating material.

30. An ink jet head according to claim 28, wherein said heat resistant insulating material is $SiO_2$.

31. An ink jet head according to claim 28, wherein said heat resistant insulating material is SiN.

32. An ink jet head according to claim 1, 5 or 3 wherein another protective layer is provided on said protective layer.

33. An ink jet head according to claim 31, wherein said another protective layer is formed using a polyimide.

34. An ink jet apparatus equipped with an ink jet head comprising:

an electrothermal transducer having a heat-generating resistor and a pair of electrodes electrically connected to said heat-generating resistor;

a base plate supporting said electrothermal transducer;

a protective layer on said electrothermal transducer of an amorphous alloy containing at least one material selected from the group consisting of Ti, Zr, Hf, Nb, Ta, W, Fe, Ni and Cr; said amorphous alloy being represented by the formula $$M_x(Fe_{100-y-z}Ni_yCr_z)_{100-x}$$

wherein M is at least one element selected from the group consisting of Ti, Zr, Hf, Nb, Ta and W, and (i) x is 10–70, (ii) y is 5–30, or (iii) z is 10–30; and a liquid path corresponding to the heat generating portion of said electrothermal transducer communicating with a discharge opening for discharging liquid.

35. An ink jet head substrate, comprising:

an electrothermal transducer having a heat-generating resistor and a pair of electrodes electrically connected to said heat-generating resistor;

a base plate supporting said electrothermal transducer; and a protective layer formed on said electrothermal transducer of am amorphous alloy containing at least one material selected from the group consisting of Ti, Zr, Hf, Nb, Ta, W, Fe, Ni and Cr; said amorphous alloy being represented by $$M_x(Fe_{100-y-z}Ni_yCr_z)_{100-x}$$

wherein M is at least one element selected from the group consisting of Ti, Zr, Hf, Nb, Ta and W, and x is 10–70.

36. An ink jet head substrate, comprising:

an electrothermal transducer having a heat-generating resistor and a pair of electrodes electrically connected to said heat-generating resistor;

a base plate supporting said electrothermal transducer; and a protective layer formed on said electrothermal transducer of an amorphous alloy containing at least one material selected from the group consisting of Ti, Zr, Hf, Nb, Ta, W, Fe, Ni and Cr, said amorphous alloy being represented by $$M_x(Fe_{100-y-z}Ni_yCr_z)_{100-x}$$

wherein M is at least one element selected from the group consisting of Ti, Zr, Hf, Nb, Ta and W, and y is 5–30.

37. An ink jet head substrate, comprising:

an electrothermal transducer having a heat-generating resistor and a pair of electrodes electrically connected to said heat-generating resistor;

a base plate supporting said electrothermal transducer; and a protective layer formed on said electrothermal transducer of an amorphous alloy containing at least one material selected from the group consisting of Ti, Zr, Hf, Nb, Ta, W, Fe, Ni and Cr, said amorphous alloy being represented by $$M_x(Fe_{100-y-z}Ni_yCr_z)_{100-x}$$

wherein M is at least one element selected from the group consisting of Ti, Zr, Hf, Nb, Ta and W, and z is 10–30.

38. An ink substrate for jet head according to claim 35, 36 or 37 wherein said amorphous alloy is represented by $$M_x(Fe_{100-y-z}Ni_yCr_z)_{100-x}$$

wherein M is at least one selected from Ti, Zr, Hf, Nb, Ta and W and x is 20–70.

39. An ink substrate for jet head according to claim 35, 36 or 38 wherein said amorphous alloy is $Ta_{50}(Fe_{73}Ni_{10}Cr_{17})_{50}$.

40. An ink substrate for jet head according to claim 35, 36 or 38 wherein said amorphous alloy is $Ti_{25}(Fe_{73}Ni_{10}Cr_{17})_{75}$.

41. An ink substrate for jet head according to claim 35, 36 or 38 wherein said amorphous alloy is $Zr_{28}(Fe_{73}Ni_{10}Cr_{17})_{72}$.

42. An ink substrate for jet head according to claim 35, 36 or 38 wherein said amorphous alloy is $Hf_{28}(Fe_{73}Ni_{10}Cr_{17})_{72}$.

43. An ink substrate for jet head according to claim 35, 36 or 38 wherein said amorphous alloy is $Nb_{56}(Fe_{68}Ni_{11}Cr_{21})_{44}$.

44. An ink substrate for jet head according to claim 35, 36 or 38 wherein said amorphous alloy is $W_{31}(Fe_{68}Ni_{11}Cr_{21})_{69}$.

45. An ink substrate for jet head according to claim 35, 36 or 38 wherein said amorphous alloy is $Ta_{32}Ti_{18}(Fe_{73}Ni_{10}Cr_{17})_{50}$.

46. An ink substrate for jet head according to claim 35, 36 or 38 wherein said amorphous alloy is $Nb_{28}Zr_{20}(Fe_{73}Ni_{10}Cr_{17})_{52}$.

47. An ink substrate for jet head according to claim 35, 36 or 38 wherein said amorphous alloy is $Hf_{35}W_{22}(Fe_{73}Ni_{10}Cr_{17})_{43}$.

48. An ink substrate for jet head according to claim 35, 36 or 38 wherein said amorphous alloy is $Ta_{40}Ti_{13}Nb_{11}(Fe_{73}Ni_{10}Cr_{17})_{36}$.

49. An ink substrate for jet head according to claim 35, 36 or 38 wherein the thickness of said protective layer is 0.1–5 μm.

50. An ink substrate for jet head according to claim 35, 36 or 38 wherein the thickness of said protective layer is 0.2–3 μm.

51. An ink substrate for jet head according to claim 35, 36 or 38 wherein said heat-generating resistor is formed between said base plate and said electrode.

52. An ink substrate for jet head according to claim 35, 36 or 38 wherein said electrode is formed between said base plate and said heat-generating resistor.

53. An ink substrate for jet head according to claim 35, 36 or 38 wherein another protective layer is provided between said base plate and said protective layer.

54. An ink substrate for jet head according to claim 53, wherein said another protective layer is formed using a heat resistant insulating material.

55. An ink substrate for jet head according to claim 53, wherein said heat resistant insulating material is $SiO_2$.

56. A substrate for liquid jet head according to claim 53, wherein said heat resistant insulating material is SiN.

57. A substrate for liquid jet head according to claim 35, 36 or 38 wherein another protective layer is provided on said protective layer.

58. A substrate for liquid jet head according to claim 56, wherein said another protective layer is formed using a polyimide.

59. The ink jet apparatus of claim 34, which further comprises a power switch.

60. An ink jet apparatus equipped with an ink jet head comprising:

an electrothermal transducer having a heat-generating resistor and a pair of electrodes electrically connected to said heat-generating resistor;

a base plate supporting said electrothermal transducer;

a protective layer on said electrothermal transducer of an amorphous alloy containing at least one material selected from the group consisting of Ti, Zr, Hf, Nb, Ta, W, Fe, Ni and Cr, wherein said amorphous alloy is represented by $$M_x(Fe_{100-y-z}Ni_yCr_z)_{100-x}$$

wherein M is at least one element selected from the group consisting of Ti, Zr, Hf, Nb, Ta and W, and y is 5–30; and a liquid path corresponding to the heat generating portion of said electrothermal transducer communicating with a discharge opening for discharging liquid.

61. The ink jet apparatus of claim 60, which further comprises a power switch.

62. An ink jet apparatus equipped with an ink jet head comprising:

an electrothermal transducer having a heat-generating resistor and a pair of electrodes electrically connected to said heat-generating resistor;

a base plate supporting said electrothermal transducer;

a protective layer on said electrothermal transducer of an amorphous alloy containing at least one material selected from the group consisting of Ti, Zr, Hf, Nb, Ta, W, Fe, Ni and Cr, wherein said amorphous alloy is represented by $$M_x(Fe_{100-y-z}Ni_yCr_z)_{100-x}$$

wherein M is at least one element selected from the group consisting of from Ti, Zr, Hf, Nb, Ta and W, and z is 10–30; and a liquid path corresponding to the heat generating portion of said electrothermal transducer communicating with a discharge opening for discharging liquid.

63. The ink jet apparatus of claim 62, which further comprises a power switch.

64. An ink jet head, comprising:

an electrothermal transducer having a heat-generating resistor and a pair of electrodes electrically connected to said heat-generating resistor;

a base plate supporting said electrothermal transducer;

a protective layer on said electrothermal transducer of an alloy containing at least one material selected from the group consisting of Ti, Zr, Hf, Nb, Ta, W, Fe, Ni and Cr; said alloy being represented by the formula $$M_x(Fe_{100-y-z}Ni_yCr_z)_{100-x}$$

wherein M is at least one element selected from the group consisting of Ti, Zr, Hf, Nb, Ta and W, and x is 10–70; and a liquid path corresponding to the heat generating portion of said electrothermal transducer communicating with a discharge opening for discharging liquid.

65. An ink jet head, comprising:

an electrothermal transducer having a heat-generating resistor and a pair of electrodes electrically connected to said heat-generating resistor;

a base plate supporting said electrothermal transducer;

a protective layer on said electrothermal transducer of an alloy containing at least one material selected from the group consisting of Ti, Zr, Hf, Nb, Ta, W, Fe, Ni and Cr, wherein said alloy is represented by $$M_x(Fe_{100-y-z}Ni_yCr_z)_{100-x}$$

wherein M is at least one element selected from the group consisting of Ti, Zr, Hf, Nb, Ta and W, and y is 5–30; and a liquid path corresponding to the heat generating portion of said electrothermal transducer communicating with a discharge opening for discharging liquid.

66. An ink jet head, comprising:

an electrothermal transducer having a heat-generating resistor and a pair of electrodes electrically connected to said heat-generating resistor;

a base plate supporting said electrothermal transducer;

a protective layer on said electrothermal transducer of an alloy containing at least one material selected from the group consisting of Ti, Zr, Hf, Nb, Ta, W, Fe, Ni and Cr, wherein said alloy is represented by $$M_x(Fe_{100-y-z}Ni_yCr_z)_{100-x}$$

wherein M is at least one element selected from the group consisting of from Ti, Zr, Hf, Nb, Ta and W, and z is 10–30; and a liquid path corresponding to the heat generating portion of said electrothermal transducer communicating with a discharge opening for discharging liquid.

67. An ink jet head according to claims 64, 65 or 66, wherein said alloy is represented by $$M_x(Fe_{100-y-z}Ni_yCr_z)_{100-x}$$

wherein M is at least one selected from Ti, Zr, Hf, Nb, Ta and W, and x is 20–70.

68. An ink jet head according to claims 64, 65 or 66, wherein said alloy is $Ta_{50}(Fe_{73}Ni_{10}Cr_{17})_{50}$.

69. An ink jet head according to claims 64, 65 or 66, wherein said alloy is $Ti_{25}(Fe_{73}Ni_{10}Cr_{17})_{75}$.

70. An ink jet head according to claims 64, 65 or 66, wherein said alloy is $Zr_{28}(Fe_{73}Ni_{10}Cr_{17})_{72}$.

71. An ink jet head according to claims 64, 65 or 66, wherein said alloy is $Hf_{28}(Fe_{73}Ni_{10}Cr_{17})_{72}$.

72. An ink jet head according to claims 64, 65 or 66, wherein said alloy is $Nb_{56}(Fe_{68}Ni_{11}Cr_{21})_{44}$.

73. An ink jet head according to claims 64, 65 or 66, wherein said alloy is $W_{31}(Fe_{68}Ni_{11}Cr_{21})_{69}$.

74. An ink jet head according to claims 64, 65 or 66, wherein said alloy is $Ta_{32}Ti_{18}(Fe_{73}Ni_{10}Cr_{17})_{50}$.

75. An ink jet head according to claims 64, 65 or 66, wherein said alloy is $Nb_{28}Zr_{20}(Fe_{73}Ni_{10}Cr_{17})_{52}$.

76. An ink jet head according to claims 64, 65 or 66, wherein said alloy is $Hf_{35}W_{22}(Fe_{73}Ni_{10}Cr_{17})_{43}$.

77. An ink jet head according to claims 64, 65 or 66, wherein said alloy is $Ta_{40}Ti_{13}Nb_{11}(Fe_{73}Ni_{10}Cr_{17})_{36}$.

78. An ink jet head according to claims 64, 65 or 66, wherein the thickness of said protective layer is 0.1–5 μm.

79. An ink jet head according to claims 64, 65 or 66, wherein the thickness of said protective layer is 0.2–3 μm.

80. An ink jet head according to claims 64, 65 or 66, wherein said heat-generating resistor is formed between said base plate and said electrode.

81. An ink jet head according to claims 64, 65 or 66, wherein said electrode is formed between said base plate and said heat-generating resistor.

82. An ink jet head according to claims 64, 65 or 66, wherein said electrothermal transducer generates heat energy used for discharging liquid.

83. An ink jet head according to claims 64, 65 or 66, wherein the direction of ink discharge from said discharge opening is substantially the same as the direction of ink supply to said heat-generating portion.

84. An ink jet head according to claims 64, 65 or 66, wherein the direction of ink discharge from said discharge opening is different from the direction of ink supply to said heat-generating portion.

85. An ink jet head according to claims 64, 65 or 66, wherein said discharge opening is provided in a plural number.

86. An ink jet head according to claims 64, 65 or 66, wherein said discharge opening is provided in a plural number corresponding to the width of recording medium.

87. An ink jet head according to claims 64, 65 or 66, wherein the member for forming said liquid path on said support is a covering member having a groove for forming said liquid path.

88. An ink jet head according to claims 64, 65 or 66, wherein the member for forming said liquid path on said support comprises a wall-forming member forming the wall of said liquid path and a top plate bonded to said wall-forming member.

89. An ink jet head according to claims 64, 65 or 66, wherein another protective layer is provided between said base plate and said protective layer.

90. An ink jet head according to claims 64, 65 or 66, wherein another protective layer is provided on said protective layer.

91. An ink jet head according to claim 84, wherein said two directions form substantially right angle.

92. An ink jet head according to claim 88, wherein said wall-forming member is formed using a photosensitive resin.

93. An ink jet head according to claim 89, wherein said another protective layer is formed using a heat resistant insulating material.

94. An ink jet head according to claim 93, wherein said heat resistant insulating material is $SiO_2$.

95. An ink jet head according to claim 93, wherein said heat resistant insulating material is SiN.

96. An ink jet head according to claim 90, wherein said another protective layer is formed using a polyimide.

97. An ink jet head substrate, comprising:

an electrothermal transducer having a heat-generating resistor and a pair of electrodes electrically connected to said heat-generating resistor;

a base plate supporting said electrothermal transducer; and a protective layer formed on said electrothermal transducer of an alloy containing at least one material selected from the group consisting of Ti, Zr, Hf, Nb, Ta, W, Fe, Ni and Cr; said alloy being represented by $$M_x(Fe_{100-y-z}Ni_yCr_z)_{100-x}$$

wherein M is at least one element selected from the group consisting of Ti, Zr, Hf, Nb, Ta and W, and x is 10–70.

98. An ink jet head substrate, comprising:

an electrothermal transducer having a heat-generating resistor and a pair of electrodes electrically connected to said heat-generating resistor;

a base plate supporting said electrothermal transducer; and a protective layer formed on said electrothermal transducer of an alloy containing at least one material selected from the group consisting of Ti, Zr, Hf, Nb, Ta, W, Fe, Ni and Cr, said alloy being represented by $$M_x(Fe_{100-y-z}Ni_yCr_z)_{100-x}$$

wherein M is at least one element selected from the group consisting of Ti, Zr, Hf, Nb, Ta and W, and y is 5–30.

99. An ink jet head substrate, comprising:

an electrothermal transducer having a heat-generating resistor and a pair of electrodes electrically connected to said heat-generating resistor;

a base plate supporting said electrothermal transducer; and a protective layer formed on said electrothermal transducer of an alloy containing at least one material selected from the group consisting of Ti, Zr, Hf, Nb, Ta, W, Fe, Ni and Cr, said alloy being represented by $$M_x(Fe_{100-y-z}Ni_yCr_z)_{100-x}$$

wherein M is at least one element selected from the group consisting of Ti, Zr, Hf, Nb, Ta and W, and z is 10–30.

100. An ink jet head substrate according to claims 97, 98 or 99, wherein said alloy is represented by $$M_x(Fe_{100-y-z}Ni_yCr_z)_{100-x}$$

wherein M is at least one selected from Ti, Zr, Hf, Nb, Ta and W, and x is 20–70.

101. An ink jet head substrate according to claims 97, 98 or 99, wherein said alloy is $Ta_{50}(Fe_{73}Ni_{10}Cr_{17})_{50}$.

102. An ink jet head substrate according to claims 97, 98 or 99, wherein said alloy is $Ti_{25}(Fe_{73}Ni_{10}Cr_{17})_{75}$.

103. An ink jet head substrate according to claims 97, 98 or 99, wherein said alloy is $Zr_{28}(Fe_{73}Ni_{10}Cr_{17})_{72}$.

104. An ink jet head substrate according to claims 97, 98 or 99, wherein said alloy is $Hf_{28}(Fe_{73}Ni_{10}Cr_{17})_{72}$.

105. An ink jet head substrate according to claims 97, 98 or 99, wherein said alloy is $Nb_{56}(Fe_{68}Ni_{11}Cr_{21})_{44}$.

106. An ink jet head substrate according to claims 97, 98 or 99, wherein said alloy is $W_{31}(Fe_{68}Ni_{11}Cr_{21})_{69}$.

107. An ink jet head substrate according to claims 97, 98 or 99, wherein said alloy is $Ta_{32}Ti_{18}(Fe_{73}Ni_{10}Cr_{17})_{50}$.

108. An ink jet head substrate according to claims 97, 98 or 99, wherein said alloy is $Nb_{28}Zr_{20}(Fe_{73}Ni_{10}Cr_{17})_{52}$.

109. An ink jet head substrate according to claims 97, 98 or 99, wherein said alloy is $Hf_{35}W_{22}(Fe_{73}Ni_{10}Cr_{17})_{43}$.

110. An ink jet head substrate according to claims 97, 98 or 99, wherein said alloy is $Ta_{40}Ti_{13}Nb_{11}(Fe_{73}Ni_{10}Cr_{17})_{36}$.

111. An ink jet head substrate according to claims 97, 98 or 99, wherein the thickness of said protective layer is 0.1–5 μm.

112. An ink jet head substrate according to claims 97, 98 or 99, wherein the thickness of said protective layer is 0.2–3 μm.

113. An ink jet head substrate according to claims 97, 98 or 99, wherein said heat-generating resistor is formed between said base plate and said electrode.

114. An ink jet head substrate according to claims 97, 98 or 99, wherein said electrode is formed between said base plate and said heat-generating resistor.

115. An ink jet head substrate according to claims 97, 98 or 99, wherein said electrothermal transducer generates heat energy used for discharging liquid.

116. An ink jet head substrate according to claims 97, 98 or 99, wherein the direction of ink discharge from said discharge opening is substantially the same as the direction of ink supply to said heat-generating portion.

117. An ink jet head substrate according to claims 97, 98 or 99, wherein the direction of ink discharge from said discharge opening is different from the direction of ink supply to said heat-generating portion.

118. An ink jet head substrate according to claims 97, 98 or 99, wherein said discharge opening is provided in a plural number.

119. An ink jet head substrate according to claims 97, 98 or 99, wherein said discharge opening is provided in a plural number corresponding to the width of recording medium.

120. An ink jet head substrate according to claims 97, 98 or 99, wherein the member for forming said liquid path on said support is a covering member having a groove for forming said liquid path.

121. An ink jet head substrate according to claims 97, 98 or 99, wherein the member for forming said liquid path on said support comprises a wall-forming member forming the wall of said liquid path and a top plate bonded to said wall-forming member.

122. An ink jet head substrate according to claims 97, 98 or 99, wherein another protective layer is provided between said base plate and said protective layer.

123. An ink jet head substrate according to claims 97, 98 or 99, wherein another protective layer is provided on said protective layer.

124. An ink jet head substrate according to claim 117, wherein said two directions form substantially right angle.

125. An ink jet head substrate according to claim 124, wherein said wall-forming member is formed using a photosensitive resin.

126. An ink jet head substrate according to claim 122, wherein said another protective layer is formed using a heat resistant insulating material.

127. An ink jet head substrate according to claim 126, wherein said heat resistant insulating material is $SiO_2$.

128. An ink jet head substrate according to claim 126, wherein said heat resistant insulating material is SiN.

129. An ink jet head substrate according to claim 123, wherein said another protective layer is formed using a polyimide.

130. An ink jet apparatus equipped with an ink jet head comprising:

an electrothermal transducer having a heat-generating resistor and a pair of electrodes electrically connected to said heat-generating resistor;

a base plate supporting said electrothermal transducer;

a protective layer on said electrothermal transducer of an alloy containing at least one material selected from the group consisting of Ti, Zr, Hf, Nb, Ta, W, Fe, Ni and Cr, wherein said alloy is represented by $$M_x(Fe_{100-y-z}Ni_yCr_z)_{100-x}$$

wherein M is at least one element selected from the group consisting of Ti, Zr, Hf, Nb, Ta and W, and y is 5–30; and a liquid path corresponding to the heat generating portion of said electrothermal transducer communicating with a discharge opening for discharging liquid.

131. The ink jet apparatus of claim 130, which further comprises a power switch.

132. An ink jet apparatus equipped with an ink jet head comprising:

an electrothermal transducer having a heat-generating resistor and a pair of electrodes electrically connected to said heat-generating resistor;

a base plate supporting said electrothermal transducer;

a protective layer on said electrothermal transducer of an alloy containing at least one material selected from the group consisting of Ti, Zr, Hf, Nb, Ta, W, Fe, Ni and Cr, wherein said alloy is represented by $$M_x(Fe_{100-y-z}Ni_yCr_z)_{100-x}$$

wherein M is at least one element selected from the group consisting of from Ti, Zr, Hf, Nb, Ta and W, and z is 10–30; and a liquid path corresponding to the heat generating portion of said electrothermal transducer communicating with a discharge opening for discharging liquid.

133. The ink jet apparatus of claim 132, which further comprises a power switch.

* * * * *

UNITED STATES PATENT AND TRADEMARK OFFICE

CERTIFICATE OF CORRECTION

PATENT NO. 5,057,856

DATED October 15, 1991

INVENTOR(S) HIROSHI TAKAGI, ET AL.

It is certified that error appears in the above-indentified patent and that said Letters Patent is hereby corrected as shown below:

On the Title Page and Column 1, line 1:

"LIQUID JET HEAD, SUBSTRATE" should read --LIQUID JET HEAD SUBSTRATE--.

COLUMN 1

Line 2, "LIQUID JET HEAD, SUBSTRATE" should read --LIQUID JET HEAD SUBSTRATE--.
Line 20, "recording for" should read --recording head for--.
Line 26, "electro-thermal" should read --electrothermal--.
Line 34, "202 a" should read --202, a--.
Line 39, "head comprises" should read --head further comprises--.
Line 46, "surfaces" should read --reinforces--.
Line 58, "¶ That" should read --That--.
Line 59, "gas lies" should read --gasifies--.
Line 61, "must breaking," should read --must provide excellent heat, breaking,--.
Line 67, "¶ For" should read --For-- and "in" should be deleted.

COLUMN 2

Line 1, "feature" should read --features--.

COLUMN 3

Line 12, "¶ Also," should read --In this regard,--.
Line 15, "¶ The" should read --The--.

UNITED STATES PATENT AND TRADEMARK OFFICE

CERTIFICATE OF CORRECTION

PATENT NO. : 5,057,856

DATED : October 15, 1991

INVENTOR(S) : HIROSHI TAKAGI, ET AL.

It is certified that error appears in the above-indentified patent and that said Letters Patent is hereby corrected as shown below:

COLUMN 3

Line 18, "layer 214 is" should read --layer 214, the constitution of the liquid jet recording head of the present invention is--.
Line 20, "it" should be deleted.
Line 21, "¶ For" should read --For--.
Line 25, "may be" should read --may also be--.
Line 28, "¶ Further," should read --Further,-- and "hed" should read --head--.
Line 32, "¶ In" should read --In--.
Line 42, "Examples." should read --Example.--.

COLUMN 4

Line 7, "$(Fe_{73}Ni_{10}Cr_{17})_{75}$" should read --$(Fe_{73}Ni_{10}Cr_{17})_{75}$-- and "as second" should read --as a second--.
Line 48, "recordding" should read --recording--.
Line 67, "to 6" should read --to 10--.

COLUMN 5

Line 44, "¶ Incidentally," should read --Incidentally,--.

COLUMN 6

Line 56, "from" should be deleted.

COLUMN 7

Line 1, "claim 1, 5 or 3" should read --claims 1, 3 or 4,--.
Line 3, "claim 1, 5 or 3" should read --claims 1, 3 or 4,--.

UNITED STATES PATENT AND TRADEMARK OFFICE

CERTIFICATE OF CORRECTION

PATENT NO. : 5,057,856

DATED : October 15, 1991

INVENTOR(S) : HIROSHI TAKAGI, ET AL.

It is certified that error appears in the above-indentified patent and that said Letters Patent is hereby corrected as shown below:

COLUMN 7

Line 5, "claim 1, 5 or 3" should read --claims 1, 3 or 4,--.
Line 7, "claim 1, 5 or 3" should read --claims 1, 3 or 4,--.
Line 9, "claim 1, 5 or 3" should read --claims 1, 3 or 4,--.
Line 11, "claim 1," should read --claims 1, 3 or 4,--.
Line 13, "claim 1, 5 or 3" should read --claims 1, 3 or 4,--.
Line 16, "claim 1, 5 or 3" should read --claims 1, 3 or 4,--.
Line 19, "claim 1, 5 or 3" should read --claims 1, 3 or 4,--.
Line 22, "claim 1, 5 or 3" should read --claims 1, 3 or 4,--.
Line 25, "claim 1, 5 or 3" should read --claims 1, 3 or 4,--.
Line 28, "claim 1, 5 or 3" should read --claims 1, 3 or 4,--.
Line 31, "claim 1, 5 or 3" should read --claims 1, 3 or 4,--.
Line 34, "claim 1, 5 or 3" should read --claims 1, 3 or 4,--.
Line 37, "claim 1, 5 or 3" should read --claims 1, 3 or 4,--.
Line 40, "claim 1, 5 or 3" should read --claims 1, 3 or 4,--.
Line 42, "same" should read --the same--.
Line 44, "claim 1, 5 or 3" should read --claims 1, 3 or 4,--.
Line 51, "claim 1, 5 or 3" should read --claims 1, 3 or 4,--.
Line 54, "claim 1, 5 or 3" should read --claims 1, 3 or 4,--.
Line 58, "claim 1, 5 or 3" should read --claims 1, 3 or 4,--.
Line 63, "claim 2," should read --claim 26,--.
Line 66, "ink head" should read --ink jet head-- and
"claim 1, 5 or 3" should read --claims 1, 3 or 4,--.

COLUMN 8

Line 1, "claim 27," should read --claim 28,--.
Line 4, "claim 28," should read --claim 29,--.
Line 6, "claim 28," should read --claim 29,--.
Line 8, "claim 1, 5 or 3" should read --claims 1, 3 or 4,--.
Line 11, "claim 31," should read --claim 32,--.

UNITED STATES PATENT AND TRADEMARK OFFICE

CERTIFICATE OF CORRECTION

PATENT NO. : 5,057,856

DATED : October 15, 1991

INVENTOR(S) : HIROSHI TAKAGI, ET AL.

It is certified that error appears in the above-indentified patent and that said Letters Patent is hereby corrected as shown below:

COLUMN 9

Line 21, "An ink substrate for jet head" should read --A substrate for an ink jet head--.
Line 29, "An ink substrate for jet head" should read --A substrate for an ink jet head--.
Line 30, "35, 36 or 38" should read --35, 36 or 37,--.
Line 32, "An ink substrate for jet head" should read --A substrate for an ink jet head--.
Line 33, "35, 36 or 38" should read --35, 36 or 37,--.
Line 35, "An ink substrate for jet head" should read --A substrate for an ink jet head--.
Line 36, "35, 36 or 38" should read --35, 36 or 37,--.
Line 38, "An ink substrate for jet head" should read --A substrate for an ink jet head--.
Line 39, "35, 36 or 38" should read --35, 36 or 37,--.
Line 41, "An ink substrate for jet head" should read --A substrate for an ink jet head--.
Line 42, "35, 36 or 38" should read --35, 36 or 37,--.
Line 44, "An ink substrate for jet head" should read --A substrate for an ink jet head--.
Line 45, "35, 36 or 38" should read --35, 36 or 37,--.
Line 47, "An ink substrate for jet head" should read --A substrate for an ink jet head--.
Line 48, "35, 36 or 38" should read --35, 36 or 37,--.
Line 50, "An ink substrate for jet head" should read --A substrate for an ink jet head--.
Line 51, "35, 36 or 38" should read --35, 36 or 37,--.
Line 53, "An ink substrate for jet head" should read --A substrate for an ink jet head--.
Line 54, "35, 36 or 38" should read --35, 36 or 37,--.
Line 56, "An ink substrate for jet head" should read --A substrate for an ink jet head--.

UNITED STATES PATENT AND TRADEMARK OFFICE

CERTIFICATE OF CORRECTION

PATENT NO. : 5,057,856

DATED : October 15, 1991

INVENTOR(S) : HIROSHI TAKAGI, ET AL.

It is certified that error appears in the above-indentified patent and that said Letters Patent is hereby corrected as shown below:

COLUMN 9

Line 57, "35, 36 or 38" should read --35, 36 or 37,--.
Line 59, "An ink substrate for jet head" should read --A substrate for an ink jet head--.
Line 60, "35, 36 or 38" should read --35, 36 or 37,--.
Line 62, "An ink substrate for jet head" should read --A substrate for an ink jet head--.
Line 63, "35, 36 or 38" should read --35, 36 or 37,--.
Line 66, "An ink substrate for jet head" should read --A substrate for an ink jet head--.
Line 67, "35, 36 or 38" should read --35, 36 or 37,--.

COLUMN 10

Line 1, "An ink substrate for jet head" should read --A substrate for an ink jet head--.
Line 2, "35, 36 or 38" should read --35, 36 or 37,--.
Line 4, "An ink substrate for jet head" should read --A substrate for an ink jet head--.
Line 5, "35, 36 or 38" should read --35, 36 or 37,--.
Line 7, "An ink substrate for jet head" should read --A substrate for an ink jet head--.
Line 10, "An ink substrate for jet head" should read --A substrate for an ink jet head--.
Line 11, "53," should read --54,--.
Line 13, "A substrate for liquid jet head" should read --A substrate for an ink jet head--.
Line 14, "53," should read --54,--.
Line 15, "A substrate for liquid jet head" should read --A substrate for an ink jet head--.
Line 16, "35, 36 or 38" should read --35, 36 or 37,--.

UNITED STATES PATENT AND TRADEMARK OFFICE

CERTIFICATE OF CORRECTION

PATENT NO. : 5,057,856

DATED : October 15, 1991

INVENTOR(S) : HIROSHI TAKAGI, ET AL.

It is certified that error appears in the above-indentified patent and that said Letters Patent is hereby corrected as shown below:

COLUMN 10

Line 18, "A substrate for liquid jet head" should read --A substrate for an ink jet head--.
Line 19, "56," should read --57,--.
Line 63, "from" should be deleted.

COLUMN 15

Line 10, "claim 124," should read --claim 121,--.

COLUMN 16

Line 26, "from" should be deleted.

Signed and Sealed this

Thirteenth Day of September, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,057,856

DATED : October 15, 1991

INVENTOR(S) : HIROSHI TAKAGI, ET AL.

It is certified that error appears in the above-identified patent and that said Letters Patent is hereby corrected as shown below:

COLUMN 6

Line 16, "claim 1," should read --claims 1, 3 or 4,-- and "wherein the member for forming said liquid path on said support is" should read --including--.

COLUMN 7

Line 59, "wherein the member for forming said liquid path on said support comprises" should read --including--.

COLUMN 12

Line 55, "wherein the member for forming said liquid path on said support is" should read --including--.
Line 59, "wherein the member for forming said liquid path on said support comprises" should read --including--.

COLUMN 14

Line 61, "wherein the member for forming said liquid path on said support is" should read --including--.
Line 63, "said" should read --a--.
Line 65, "wherein the member for forming said liquid path on said support comprises" should read --including--.

UNITED STATES PATENT AND TRADEMARK OFFICE

CERTIFICATE OF CORRECTION

PATENT NO. : 5,057,856

DATED : October 15, 1991

INVENTOR(S) : HIROSHI TAKAGI, ET AL.

It is certified that error appears in the above-identified patent and that said Letters Patent is hereby corrected as shown below:

COLUMN 14

Line 66, "the" should read --a-- and
"said" should read --a--.

Signed and Sealed this

Twenty-ninth Day of November, 1994

*Attest:*

Bruce Lehman

BRUCE LEHMAN

*Attesting Officer*

*Commissioner of Patents and Trademarks*

--